US005126721A

United States Patent [19]

Butcher et al.

[11] Patent Number: 5,126,721

[45] Date of Patent: Jun. 30, 1992

[54] FLAME QUALITY MONITOR SYSTEM FOR FIXED FIRING RATE OIL BURNERS

[75] Inventors: Thomas A. Butcher, Pt. Jefferson; Philip Cerniglia, Moriches, both of N.Y.

[73] Assignee: The United States of America as represented by the United States Department of Energy, Washington, D.C.

[21] Appl. No.: 601,952

[22] Filed: Oct. 23, 1990

[51] Int. Cl.[5] ..... G08B 21/00

[52] U.S. Cl. ..... 340/578; 250/554; 431/13

[58] Field of Search ..... 340/578; 250/554; 431/13, 79

[56] References Cited

U.S. PATENT DOCUMENTS

| | | | |
|---|---|---|---|
| 3,537,804 | 11/1970 | Walbridge | 431/66 |
| 4,435,149 | 3/1984 | Astheimer | 431/12 |
| 4,639,727 | 1/1987 | Demeirsman | 340/578 |
| 4,756,684 | 7/1988 | Nishikawa et al. | 431/79 |

OTHER PUBLICATIONS

Butcher et al., "Advanced Control Strategies", Proceedings of the 1989 Oil Heat Technology Conference and Workshop; Jun. 1989.

Butcher et al., "Advanced Control Strategies", Fuel Oil News; Apr. 1990.

Butcher et al., "Field Tests on Advanced Control Strategies", Oil Heat Tech. Conf. and Workshop; Mar. 1990.

Butcher, "Performance Control Strategies for Oil--Fired Residential Heating Systems", Project Report; Jul. 1990.

*Primary Examiner*—Glen R. Swann, III

*Attorney, Agent, or Firm*—Mark P. Dvorscak; Robert J. Fisher; William R. Moser

[57] ABSTRACT

A method and apparatus for determining and indicating the flame quality, or efficiency of the air-fuel ratio, in a fixed firing rate heating unit, such as an oil burning furnace, is provided. When the flame brightness falls outside a preset range, the flame quality, or excess air, has changed to the point that the unit should be serviced. The flame quality indicator output is in the form of lights mounted on the front of the unit. A green light indicates that the flame is about in the same condition as when the burner was last serviced. A red light indicates a flame which is either too rich or too lean, and that servicing of the burner is required. At the end of each firing cycle, the flame quality indicator goes into a hold mode which is in effect during the period that the burner remains off. A yellow or amber light indicates that the burner is in the hold mode. In this mode, the flame quality lights indicate the flame condition immediately before the burner turned off. Thus the unit can be viewed when it is off, and the flame condition at the end of the previous firing cycle can be observed.

9 Claims, 7 Drawing Sheets

FLAME QUALITY MONITOR SYSTEM FOR FIXED FIRING RATE OIL BURNERS

CONTRACTUAL ORIGIN OF THE INVENTION

The United States Government has rights in this invention pursuant to Contract No. DE-AC02-76CH00016 between the U.S. Department of Energy and Associated Universities, Inc.

BACKGROUND OF THE INVENTION

Currently, a residential owner of an oil burning furnace calls for burner service either when there is no heat or when an odor is noticed. This need for service often results from inefficient oil burners. In addition to no heat or the production of odors, an inefficient burner also produces soot. Sooting results in fouling of the heat exchanger of the boiler or furnace.

The thermal efficiency of residential oil fired heating equipment in service is lower than the efficiencies that can be achieved with the same equipment under ideal conditions. Two primary factors are responsible. First, there is often a failure to adjust burners during equipment installation and servicing for minimum excess air. Second, a deterioration of thermal performance between tune-ups in continuous service occurs due to soot accumulation on the heat exchanger surfaces.

For maximum thermal efficiency oil burners should have their air/fuel ratios adjusted to produce a "trace" smoke level in the flue (a "trace" smoke level is equivalent to a smoke number between 0 and 1 on the Shell-/Bacharach Scale). A burner adjusted this way in 15 steady state, however, will have significantly higher smoke levels during routine, cyclic operation. These higher levels are due to three factors:

1. an ignition pressure peak in the combustion chamber, which has been shown to produce increasingly severe smoke peaks as excess air is reduced;
2. after ignition the average temperature in the chimney is lower than in steady state, leading to reduced draft and excess air; and
3. after ignition the combustion chamber walls are still relatively cold, also leading to increased smoke.

Additionally, changes in fuel quality between service calls, as well as excess air changes due to weather conditions, might produce a soot problem for burners set with marginal excess air. Service personnel adjust burners to have generous excess air levels to prevent problems which might require a return visit to the home. Unfortunately, this results in relatively poor operating efficiency compared with the maximum level that can be achieved.

Increasing excess air decreases efficiency by increasing the mass flow rate and temperature of the combustion products discarded to the outdoors. To illustrate the magnitude of these effects, assume that a burner is adjusted to 9% $CO_2$, rather than an optimal level of 12%. This corresponds to 68% excess air versus the optimal level of about 30%. Stack gas temperature would be about 70° F. higher due to the unneeded excess air. The steady state efficiency would be about 6% lower as a result of these two effects. This example assumes that service personnel have the adequate instrumentation to properly adjust the air/fuel ratio and that the adjustments are actually made. In many cases burners are installed without proper adjustment, leading to very high excess air settings with reduced efficiency and/or service problems.

Estimates of the magnitude of the annual degradation in thermal efficiency based on earlier published studies show considerable variation between units. An average degradation of 2% per year has been used. Principal causes of deterioration are seen as fouling of the heat exchanger surfaces by soot, fouling of the oil nozzle, and changes in the air/fuel ratio caused by dust.

The introduction of advanced control systems can increase efficiency and reduce fuel consumption due to both high excess air and heat exchanger fouling. Two basic control modes can be considered for maintaining high efficiency operation:

1. Service-required signals. In this mode the homeowner or service company would be made aware that smoke production and/or efficiency have degraded to the point where service is required.
2. Steady-state excess-air trim. In this mode the burner would essentially tune itself continuously for maximum efficiency. Excess air would be changed in response to changes in fuel quality, draft, nozzle erosion, etc. to maintain "trace" smoke in steady state.

The service-required signal mode would reduce fuel consumption by reducing operating time in a degraded condition. A control approach for this mode could be as simple as monitoring the stack temperature as an indicator of fouling. The simplicity of this approach offers a great advantage. However, the homeowner is alerted only after the heat exchanger surfaces have become fouled. A control system which alerts the homeowner when the burner has just begun producing high smoke would eliminate the need for disassembly and cleaning of the unit. This mode could be achieved by measuring smoke, gaseous hydrocarbons, carbon monoxide, or flame optical emissions (color). The present invention is directed to a control system in which the flame optical emission is measured.

Optical methods of flame diagnostics have received increasing attention in recent years and offer a practical method of sensing the quality of an oil burner flame. Monitoring the intensity of the broadband emission from the flame has been found to be a very useful indicator of the excess air. Relative to larger, non-residential burner systems, which have variable or two stage firing rates, the application to fixed firing rate residential systems is simpler. After a burner has been serviced the flame brightness should be about the same each time it fires. The flame brightness with variable firing rate burners is a function of the firing rate.

Measurements of the intensity of light emitted from oil burner flames as a function of wavelength are illustrated in FIGS. 1 and 2. The general nature of the light emitted from oil burner flames is illustrated in FIG. 1. The emission can be considered to consist of two primary parts. The first, or dominant part, is the continuum emission which is like a black body curve and is due to emissions from soot particles in the flame. The second part of the spectra has smaller peaks due to emissions from specific gas phase species in the flame (e.g. OH, $CO_2$, or CO). FIG. 2 shows an example of measured spectral intensity of radiant energy from an oil flame over the ultraviolet (200–400 nm) and a portion of the visible range (>400 nm). The peak centered at 310 nm wavelength is due to emission from OH. The remainder of the emission is the continuum emission.

The brightness or color of an oil burner flame can be used as a measure of the burner air/fuel or flame quality.

For burners which operate at a firing rate which is fixed (for example, by nozzle size), the flame brightness or color at a specific air fuel ratio and with the burner operating in steady state should be constant over time. Monitoring flame brightness or color then, can be a useful method of detecting deterioration of the burner performance over time. As used herein, deteriorated performance means increased smoke or increased excess air, which leads to reduced efficiency. Such deterioration can be caused by a fouled nozzle, fouling of the burner intake openings, a chimney restriction, a fouled heat exchanger, or the collapse of the refractory liner in the combustion chamber. Fixed firing rate burner systems meet a variable load by cycling on and off. In residential oil fired heating equipment, burners cycle 6,000 to 10,000 times each year. During each firing cycle the flame color and brightness changes as the combustion chamber walls warm to their steady state value, with the flame brightness lower at start-up than in steady state. This warm-up period varies from ½ to 5 minutes and comprises a significant portion of the on-cycle of the burner.

Accordingly, an object of this invention is to provide an advanced burner control system in residential oil burning furnace which alerts the homeowner to inefficient conditions prior to degradation of the furnace.

Another object of this invention is to provide an advanced means for producing a service call to a residential furnace, prior to the time that burner inefficiency causes severe fouling of the heat exchanger of the boiler or furnace.

A further object of this invention is to reduce heat exchanger cleanings and soot spillage into a home.

Yet another object of this invention is to provide a means for continually indicating the quality of the flame emitted by an oil burning furnace, whether the burner is on or off.

SUMMARY OF THE INVENTION

To achieve the foregoing and other objects, and in accordance with the purposes of the present invention, as embodied and described here, a method aspect for monitoring the quality of a flame in a fixed firing rate heating unit includes sensing the brightness of the flame while the unit is firing; determining the quality of the flame by comparing the sensed brightness with a range of predetermined values indicative of the flame quality and; and providing a means for indicating the quality of the flame. This invention also contemplates indicating, while the unit is not firing, the quality of the flame during the immediately preceding firing period.

Another method aspect of the present invention determines whether the air-fuel ratio in a fixed firing rate heating unit is correctly adjusted by sensing the brightness of the flame during a firing cycle of the unit; providing a range of predetermined values representative of optimum and non-optimum air-fuel ratios associated with flame brightness; comparing the brightness of the flame with the range of predetermined values and then determining whether the air-fuel ratio is optimum or non-optimum, and indicating whether the air-fuel ratio during the immediately preceding firing cycle was optimum or non-optimum. A step is also provided for simultaneously indicating whether the unit is not firing and whether the air-fuel ratio during the immediately preceding firing cycle was optimum or non-optimum. The predetermined range of values can include a setpoint range of electrical signals that are associated with the air-fuel ratio of the flame. In this case, the brightness signal of the flame is compared with the setpoint range to determine whether the air-fuel ratio is optimum or non-optimum.

An apparatus for monitoring the condition of a flame in a fixed firing rate heating unit includes a means for sensing the brightness of the flame while the furnace is firing and for converting the brightness into an electrical signal; means for storing a predetermined range of electrical signals characteristic of the flame condition; comparator means for comparing the brightness signal with the predetermined range; means responsive to the comparator means for determining the flame's condition; and a means for displaying the flame condition. The display means can display whether the condition of the flame is optimum or non-optimum. Additionally, the apparatus can include means for simultaneously indicating whether the unit is not firing and whether the condition of the flame during the immediately preceding firing cycle was optimum or non-optimum. The heating unit can be an oil burning furnace.

BRIEF DESCRIPTION OF THE DRAWINGS

The above-mentioned and other features of the invention will become more apparent and best understood, together with the description, by reference to the accompanying drawings, in which.

DETAILED DESCRIPTION OF THE INVENTION

Figure 6:
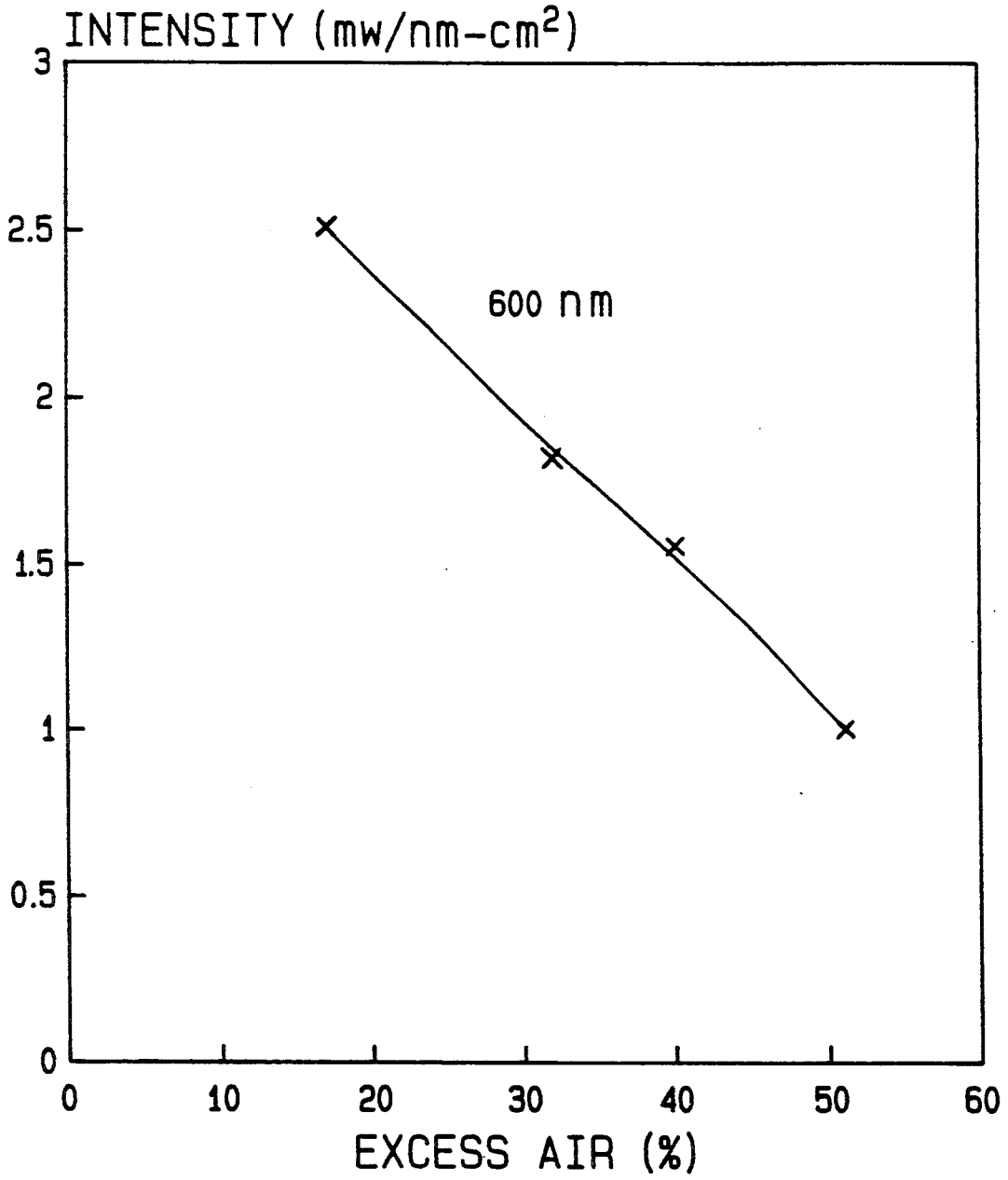
FIG. 6 shows a variation of the continuum intensity with excess air (at 600 nm, 1 gph)

The objects of the present invention were achieved with reference to optical studies performed over a broad range of conditions. Parameters examined in the studies included excess air, firing rate, nozzle spray pattern, nozzle condition, fuel quality, combustion chamber refractory liners, and transient effects during cyclic operation. From these studies it was concluded that as burner excess air increases the continuum intensity decreases, the apparent flame color tends to increase, and the intensity of the OH peak in the UV is fairly constant. FIG. 6 shows a sample representation of the variation of the continuum intensity with excess air at a wavelength of 600 nm. Monitoring the intensity of the broadband emission from the flame is a useful indicator of the excess air. It is possible, for example, to set the excess air in the burner to produce a specific level of broadband intensity. This can be accomplished by using a simple sensor such as a cadmium sulfide photoconductor.

Figure 1:
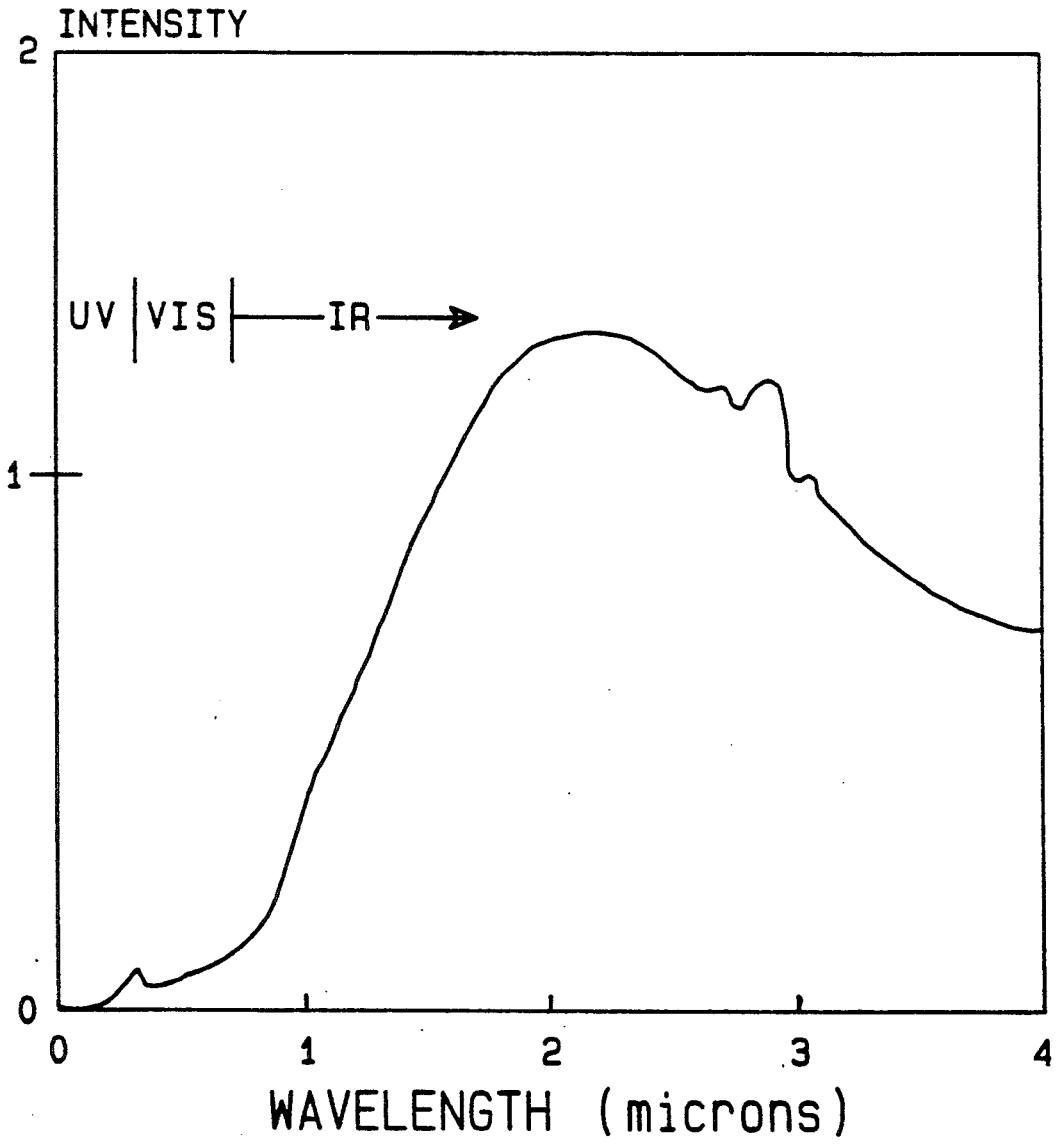
FIG. 1 is a general illustration of an oil flame emission spectra.
Figure 2:
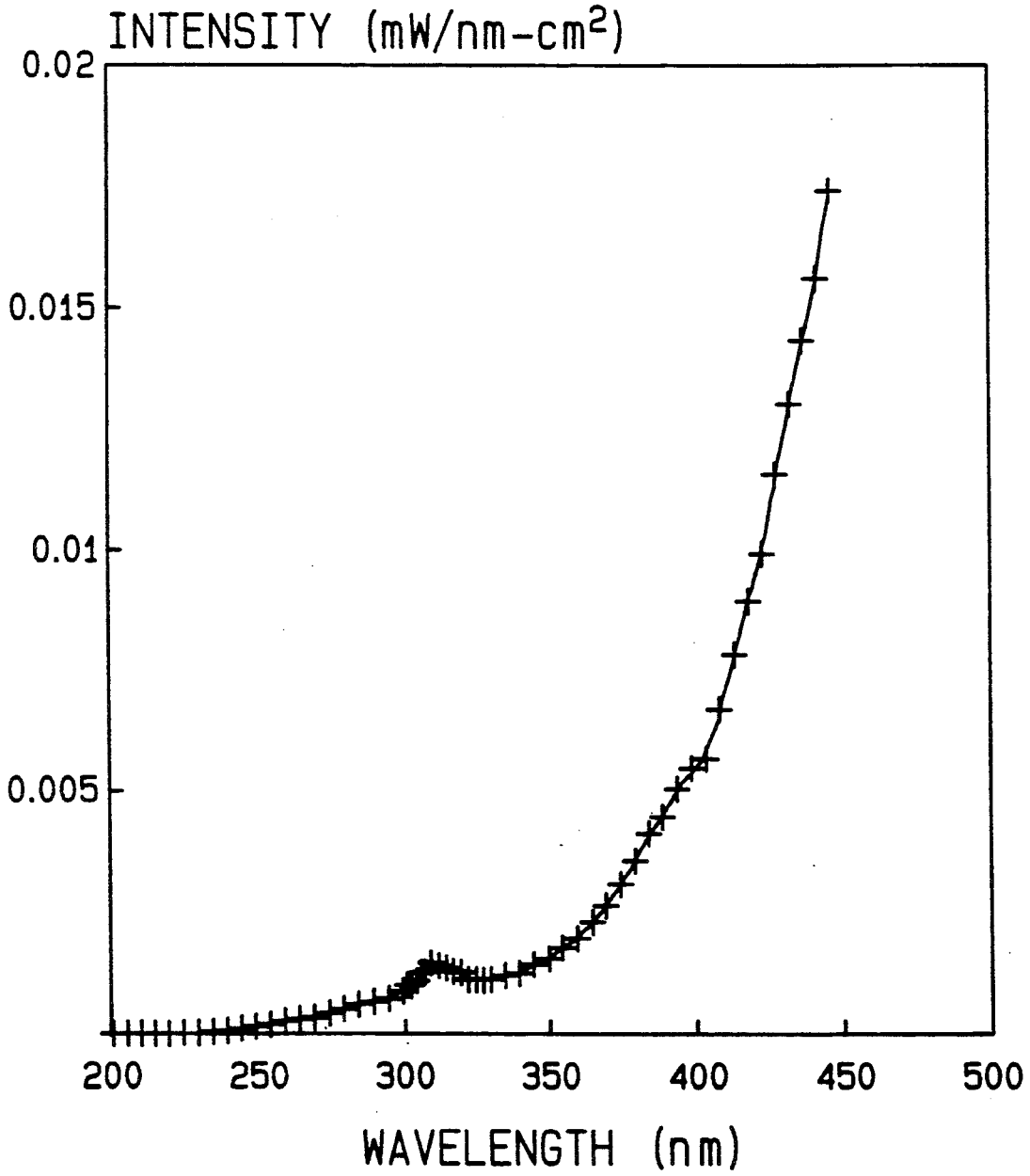
FIG. 2 shows the spectral intensity from an oil flame over the ultraviolet and a portion of the visible.
Figure 3:
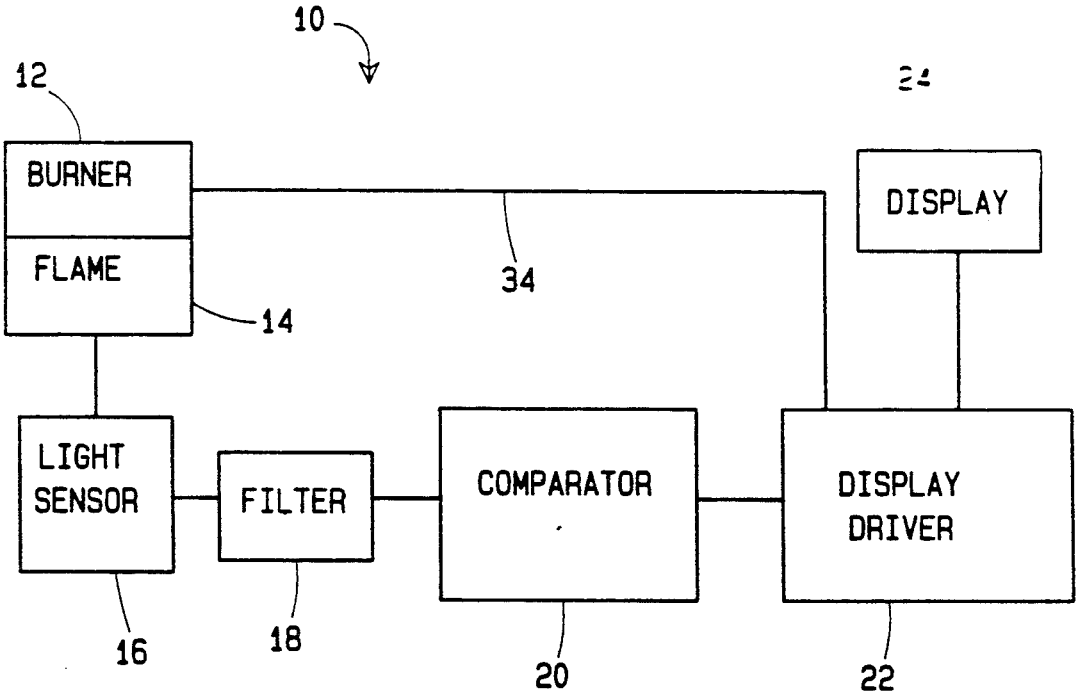
FIG. 3 shows a block diagram of a flame quality indicator.

Referring to FIG. 3, a flame quality monitor system 10 in accordance with the present invention is schematically depicted. A flame 14 emitted from the burner 12 of an oil burning furnace is sensed by light sensor 16. The furnace (not shown) is any conventional residential oil burning furnace having on and off firing cycles. For example, a typical home furnace may have a burner which operates 10 minutes on and 15 minutes off depending on the heating requirements of the residence in which the furnace is situated.

Figure 4:
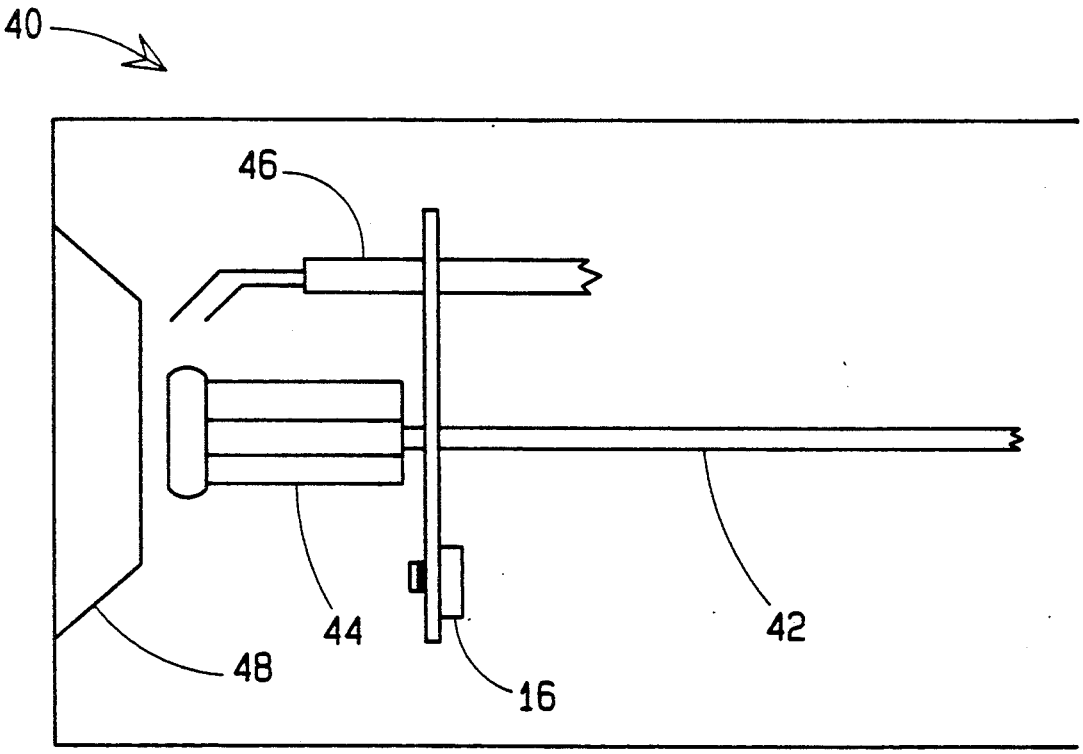
FIG. 4 shows a detailed view of burner air tube having a photo-sensor.

The flame 14 emitted by the burner 12 is sensed by a photosensor 16, such as a cadmium sulfide (CdS—"cad") photocell which photoelectrically converts the light into an electrical voltage signal corresponding to the spectral intensity of the flame. FIG. 4 shows the location of the sensor 16 in a burner air tube 40. A fuel line 42 directs fuel to nozzle 44. Also shown is an ignitor 46 and retention head 48. The sensor 16 is mounted on the fuel line 42 of the burner.

The photosensor 16 is a variable resistor. To allow output signals from spectral intensity measurements to be converted to a meaningful numerical scale, calibration of systems can be done using a standard tungsten-halogen light source. A calibration using a tungsten-halogen light and cad cell indicates that the resistance R is roughly related to intensity I by the following:

$$R\text{-}I^{-n}$$

The value of n approaches 1 at low levels of light intensity and decreases toward zero at high intensity levels. A high value of n means high sensitivity. For measurements made with the embodiment disclosed herein, the intensity was in the range which produced an n value of about 0.5. This relationship thus allows relative flame intensity to be inferred from measured resistance, or:

$$I \propto \frac{1}{R^2}$$

Figure 7:
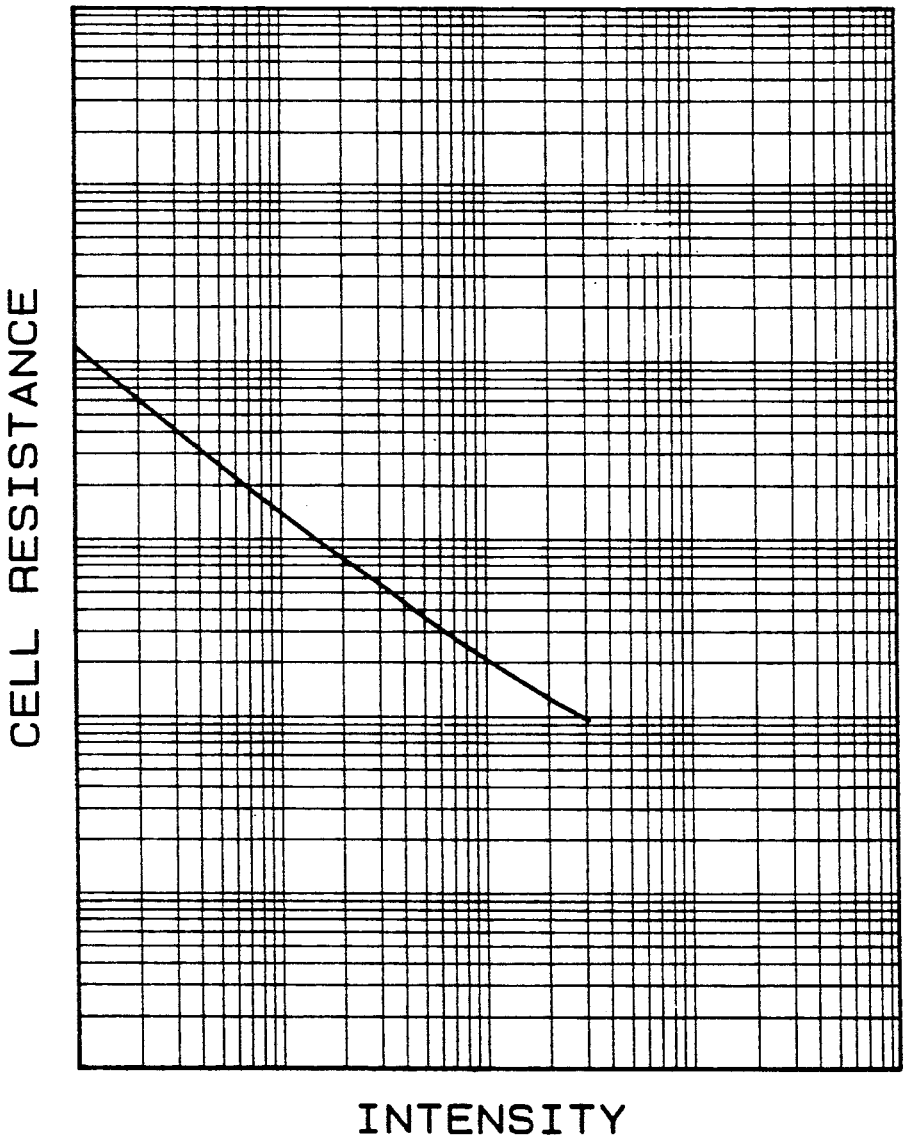
FIG. 7 shows relationship between the light intensity and resistance of a cad cell.
Figure 8:
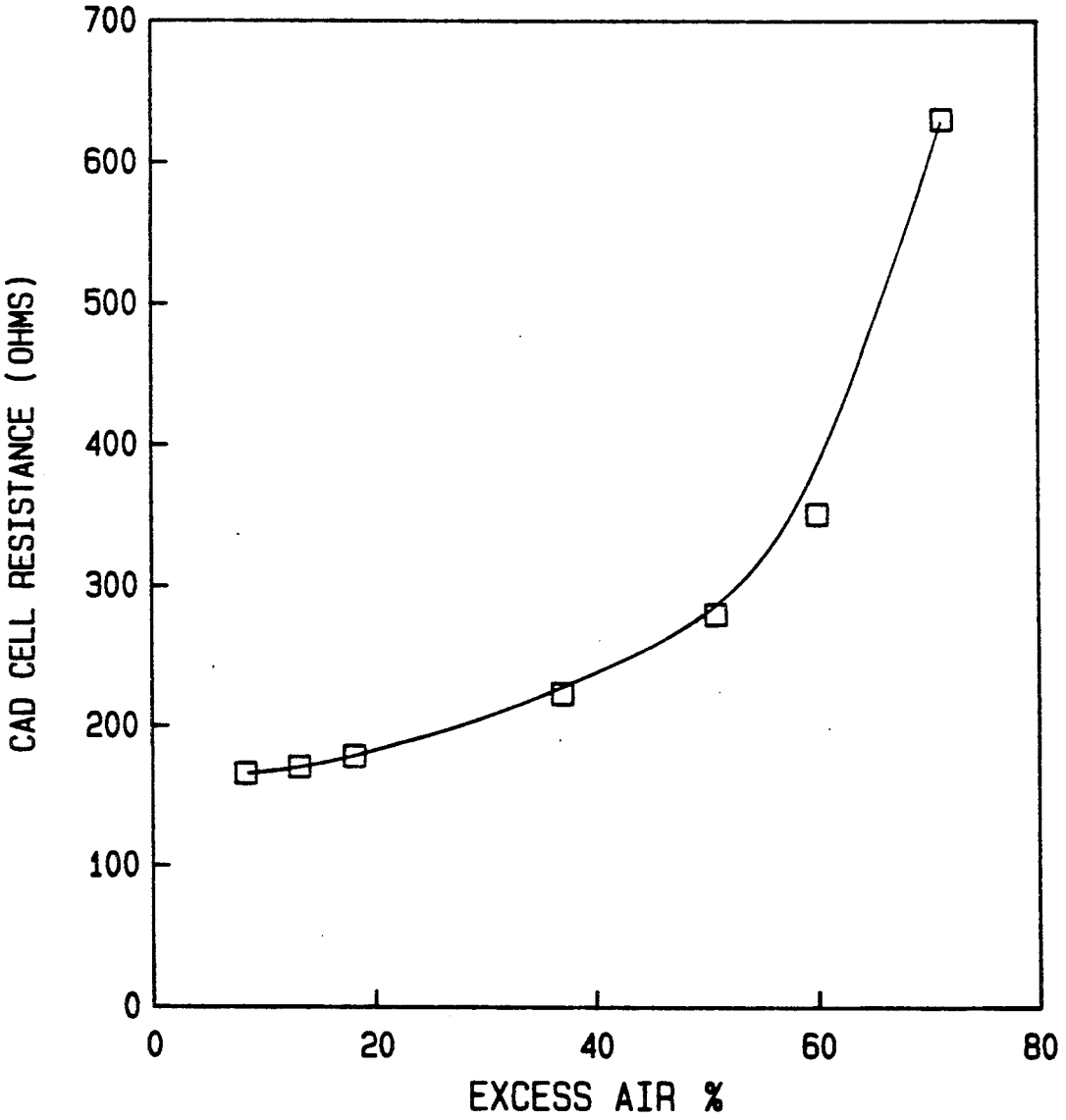
FIG. 8 shows the variation in the resistance of a cad cell with excess air, the cad cell being located just behind the retention head.

A graphical illustration of this relationship is shown in FIG. 7. The variation in the resistance of the cad cell 16 with excess air is shown in FIG. 8.

The light intensity of the flame is dependent upon the burner excess air and flame quality. The photosensor 16 is preferably responsive to the black body wavelength emission emitted from oil flames. Two photosensors, each having a different wavelength response, can also be utilized. This arrangement would compensate for reduced sensitivity due to fouling of the photosensor. The ratio of the two intensities read by each sensor would be used to provide an electric signal corresponding to the intensity of the flame.

Once the light emitted by the flame is converted into an electrical voltage signal, this signal is passed through filter 18. The filter 18 is an electronic filter having a capacitor and a resistor which dampens the voltage output received from the photosensor 16. This filter is a low pass filter which allows only the direct, or steady state, voltage signal through. Thus fluctuating signals resulting from flame flicker do not pass through filter 18.

The signal passing through filter 18 is sent to comparator 20. Comparator 20 is a device which compares the signal passing through the filter 18 with a predetermined setpoint range. The signal passed to the comparator 20 is compared with the setpoint voltage range for a determination of whether the signal is within the setpoint. If the signal is not within the setpoint, the comparator 20 also determines whether it is above or below the setpoint. Comparison of the signal received via the photosensor 16 with the setpoint voltage thus determines the condition or quality of the flame 14. A voltage within the range of the setpoint indicates the air-fuel ratio is adjusted correctly, and that the flame quality is optimum. If the voltage is not within the setpoint range, the air-fuel ratio is not properly adjusted, providing either a too rich or too lean of a mixture.

After the voltage is compared with the ranges in the comparator, it is passed to a display driver 22 which provides a power signal to the flame quality indicator display 24. Display 24 has a box 26 provided with a plurality of light emitting diodes (LEDs) 28, 29, and 30, one of which will shine depending on the compared voltage determined by the comparator 20.

Figure 5:
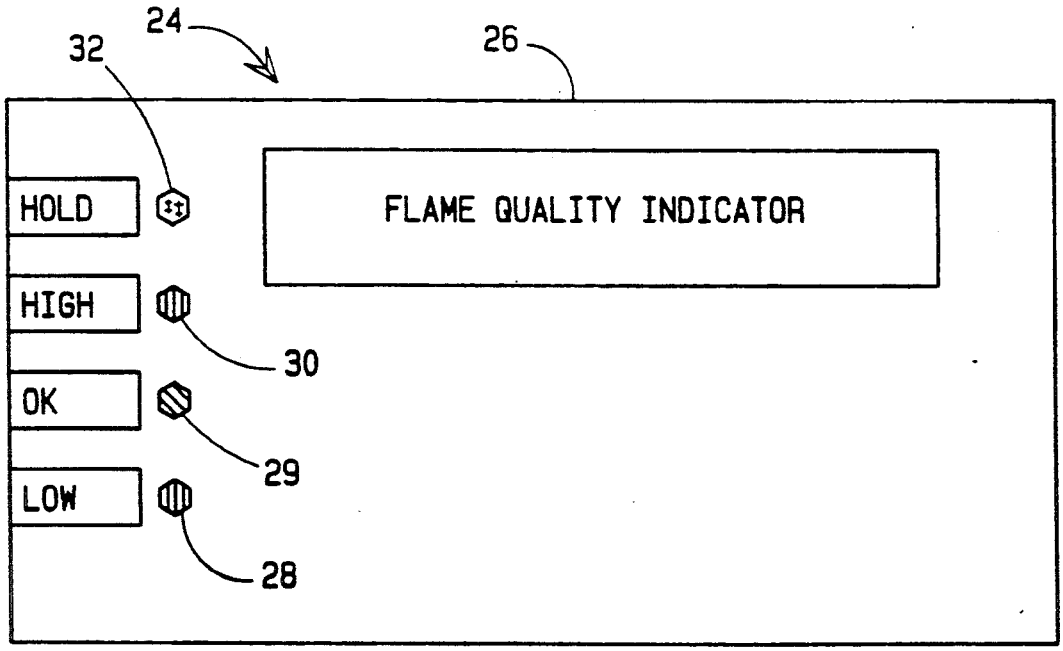
FIG. 5 shows a close-up view of a flame quality indicator display.

A detailed illustration of the flame quality indicator display 24 is provided in FIG. 5. A plurality of LEDs on the display 24 are provided for indicating the condition of the flame. LEDs 28 and 30 are red lights which indicate that the compared voltage is not within the setpoint provided in the comparator. Light 28 shines when the voltage is lower than the setpoint, or when the air-fuel ratio is too lean. Light 30 shines when the voltage is higher than the setpoint or when the air-fuel ratio is too rich. Light 29 is a green "OK" light which shines when the voltage is within the range of the setpoint, indicating a properly adjusted air-fuel ratio.

The flame quality indicator also indicates the condition of the flame when the burner is off. At the end of each firing cycle, the flame quality indicator goes into a hold mode which is in effect during the entire period that the burner is off. Amber or yellow LED 32 shines when the indicator is in the hold mode. A line 34 is provided from burner 12 to the display driver 22. This line sends a signal to the display driver 22 for indicating when the burner is off. When the burner is off, light 32 shines to so indicate. Simultaneously with the shining of light 32, one of lights 28, 29, or 30 will shine. In this manner, the flame quality is "held" during the off cycle of the burner, providing a means for an observer, such as the homeowner, to view the condition of the flame during the immediately preceding firing cycle. When the burner cycles on, the light 32 does not shine, and the condition of the flame is simply indicated by one of the red or green LEDs 28, 29 or 30. Instead of the three LEDs 28, 29, and 30, an LED array could be used to indicate a wider range of flame quality and/or excess air.

The flame quality indicator 24 can be placed locally at the site of the burner or furnace, or remote at some other location. The remote location could be integral with the thermostat in a residential heating system. Additionally, the signal from the display driver 22 could be communicated via telephone lines to a distant monitoring station.

There has thus been shown a simple device for monitoring the brightness of an oil burner flame using a conventional cad cell sensor. The invention can be used for early indication of a change in flame quality which might be caused by nozzle fouling, chamber collapse, or a severe change in fuel quality. Such an indication would result in the burner being serviced and the fault corrected. This early indication and correction of burner problems would also reduce soot fouling of the heat exchanger. The flame quality indicator described can be added to any existing oil burning furnace. Without departing from the scope of the invention, the device can also be integrated with an oil burning control, eliminating the need for a separate box 24. In addition to use for continuous flame monitoring, the flame quality indicator can be used as a service tool on a furnace on which it is not installed. Service technicians can adjust the excess air of a furnace based only on the condition of the indicator lights.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described to best explain the principles of the invention and its practical application and thereby enable others skilled in the art to best utilize the invention in various embodiments and with various modifications as are suited to the particular use contemplated. It is intended that the scope of the invention be defined by the claims appended hereto.

The embodiments of the invention in which exclusive property rights or privileges are claimed are defined as follows:

1. A method for monitoring the quality of a flame in a fixed firing rate heating unit comprising:

a) sensing the flame brightness while the unit is firing;

b) determining the quality of the flame by comparing the sensed brightness with a range of predetermined values indicative of flame quality; and, c) indicating the flame quality.

2. The method of claim 1 including the step of indicating, while the unit is not firing, the quality of the flame during the immediately preceding firing period.

3. A method for determining whether the air-fuel ratio of a flame in a fixed firing rate heating unit is correctly adjusted comprising:

a) sensing the brightness of the flame during a firing cycle of the unit;

b) providing a range of predetermined values representative of optimum and non-optimum air-fuel ratios associated with the flame brightness;

c) comparing the brightness of the flame with the range of predetermined values and determining whether the air-fuel ratio is optimum or non-optimum;

d) indicating whether the air-fuel ratio is optimum or non-optimum.

4. The method of claim 3 including the step of providing a means for simultaneously indicating when the unit is not firing and whether the air-fuel ratio during the immediately preceding firing cycle was optimum or non-optimum.

5. The method of claim 4 wherein the sensed brightness is converted into an electrical signal;

the predetermined range of values includes a setpoint range of electrical signals associated with the air-fuel ratio of the flame; and, the brightness signal is compared with the setpoint range to determine whether the air-fuel ratio is optimum or non-optimum.

6. An apparatus for monitoring the condition of a flame in a fixed firing rate heating unit comprising:

a) means for sensing the brightness of the flame while the unit is firing and for converting the brightness into an electrical signal;

b) means for storing a predetermined range of electrical signals characteristic of the flame condition;

c) comparator means for comparing the brightness signal with the predetermined range;

d) means, responsive to the comparator means, for determining the flame condition;

e) means for displaying the flame condition.

7. Apparatus according to claim 6 wherein the displaying means displays whether the condition of the flame is optimum or non-optimum.

8. Apparatus according to claim 7 including means for simultaneously indicating when the unit is not firing and whether the condition of the flame during the immediately preceding firing cycle was optimum or non-optimum.

9. Apparatus according to claim 8 wherein the heating unit is an oil burning furnace.

* * * * *